US007591454B2

(12) United States Patent
Chapman et al.

(10) Patent No.: US 7,591,454 B2
(45) Date of Patent: Sep. 22, 2009

(54) PAPER HANDLING SYSTEM MATERIAL FEED PATH ARRANGEMENT

(75) Inventors: Carl R. Chapman, Monroe, CT (US); James A. Fairweather, Milford, CT (US); Thomas M. Lyga, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 748 days.

(21) Appl. No.: 11/084,233

(22) Filed: Mar. 18, 2005

(65) Prior Publication Data

US 2006/0220296 A1 Oct. 5, 2006

(51) Int. Cl.
*B65H 39/00* (2006.01)

(52) U.S. Cl. ..... 270/58.06; 270/52.19; 270/52.2; 270/58.07; 270/58.14; 270/58.18

(58) Field of Classification Search ..... 270/52.14, 270/52.19, 52.2, 52.22, 58.01, 58.06, 58.07, 270/58.14, 58.18, 58.23, 58.29; 271/9.01, 271/279

See application file for complete search history.

(56) References Cited

U.S. PATENT DOCUMENTS 4,033,807 A * 7/1977 Neill et al. ..... 156/384
4,202,150 A * 5/1980 Petersson ..... 53/206
4,972,655 A * 11/1990 Ogawa ..... 53/155
5,117,610 A * 6/1992 Hartman et al. ..... 53/411
5,810,346 A * 9/1998 Jorg ..... 270/59
6,213,456 B1 * 4/2001 Hirano et al. ..... 270/58.08
6,366,827 B2 * 4/2002 Krasuski et al. ..... 700/220
6,381,443 B1 * 4/2002 Kawata et al. ..... 399/407
6,908,078 B2 * 6/2005 Suzuki et al. ..... 270/15
2001/0032033 A1 * 10/2001 Krasuski et al. ..... 700/220

* cited by examiner

*Primary Examiner*—Gene Crawford
*Assistant Examiner*—Leslie A Nicholson, III
(74) *Attorney, Agent, or Firm*—Brian A. Lemm; Angelo N. Chaclas

(57) ABSTRACT

A materials handling system includes a feeder station having a plurality of material feeders and an insertion subsystem. Each of the plurality of feeders are connected to a common material transport path. A first material transport path is connected to the common material transport path and to the insertion subsystem. A second material transport path is connected to the common material transport path and to the insertion subsystem. A third material transport path is connected to the first material transport path and to said insertion subsystem. The second material transport path may include a materials processing subsystem such as a folder subsystem. The common materials transport may include a pre-fold accumulator transport having a pre-fold accumulator gate. A first diverter may be provided to selectively divert materials being transported by the pre-fold accumulator transport to the first or to the second material transport. A second diverter may also be provided to selectively divert materials traveling along the first materials transport to the third material transport.

3 Claims, 5 Drawing Sheets

PAPER HANDLING SYSTEM MATERIAL FEED PATH ARRANGEMENT

RELATED APPLICATIONS

The following application includes common inventorship, and has common drawings, detailed description, filing date and assignee and relates to insertion systems: U.S. application Ser. No. 11/084,396, for PAPER HANDLING SYSTEM MATERIALS EXIT PATH ARRANGEMENT.

FIELD OF THE INVENTION

The present invention relates to paper handling systems, such as paper handling equipment, and more particularly to a folder and insertion system with a common feed path arrangement for various materials to be processed.

BACKGROUND OF THE INVENTION

Insertion equipment desirably is capable of reliably handling a large variety of materials that are to be processed. The materials may be sheets to be folded, pre-folded and unfolded inserts, return or enclosure envelopes, and the enclosure envelope into which the materials are to be inserted. These materials may be of different sizes, thickness and types such as glossy pamphlets, advertising brochures or very thin sheet materials. Additionally the envelopes into which the materials are to be inserted can have different shaped envelope flaps, envelope throat profiles and envelope flap glue lines. Reliably processing such a range of materials is difficult and has led to equipment being designed with separate dedicated feed stations and transport paths for various categories of materials to be processed. Moreover, dedicated material feed stations in an insertion system can be difficult to position without blocking vital subsystems or must be remotely located in a difficult to access areas of the equipment.

SUMMARY OF THE INVENTION

It is an object of the present invention to provide materials handling equipment, such as a folder and/or inserter system or other paper handling equipment, with a common feed path arrangement for various types of materials to be processed.

It is a further object of the present invention to provide material handing equipment that has material inputs located in a common area for operator convenience, to improve access to subsystems, reduce cost, and improve system versatility.

The present invention allows enclosure envelopes, unfolded sheets of paper, and folded sheets of paper and other inserts such as pamphlets, to be fed from a common material feed area with a common feed transport path. By allowing materials to be fed from a single area in the system, access to the various feed bins is improved, vital subsystems are not blocked, and the common material loading station improves convenience to the operator. Cost savings can also be realized since the transport subsystems are used for both the enclosure envelope and the contents to be inserted. This allows for the loading of all materials to be used in the creation of a mailpiece to be placed into feed bins all located in a common feeder station.

The feed arrangement provides a face down, horizontal envelope insertion system having a common area feed station for enclosure envelopes, sheets, and insert materials. This is facilitated by a paper path that includes material moving from the common feed station that can be transported into the folder and be folded in a variety of ways, or can entirely bypass the folder without bending. The feed path arrangement also provides a suitable transport path for envelopes from the common feed station to the insertion area while allowing for proper material sequencing without process interruption.

A materials handling system embodying the present invention includes a feeder station having a plurality of material feeders and an insertion subsystem. Each of the plurality of feeders are connected to a common material transport path. A first material transport path is connected to the common material transport path and to the insertion subsystem. A second material transport path is connected to the common material transport path and to the insertion subsystem. A third material transport path is connected to the first material transport path and to said insertion subsystem.

In accordance with an aspect of the present invention the second material transport path includes a materials processing subsystem. One such materials processing subsystem is a folder subsystem.

In accordance with an embodiment of the present invention, a materials handling system includes a feeder station having a plurality of material feeders and an insertion subsystem. Each of the plurality of feeders are connected to a common material transport. The common materials transport sequentially transports materials fed from each of the plurality of feeders. The common materials transport includes a pre-fold accumulator transport having a pre-fold accumulator gate. The pre-fold accumulator gate is operable to be positioned to stop ongoing transport and to accumulate materials being sequentially transported by the pre-fold accumulator transport and operable to be positioned to allow ongoing transport of materials being sequentially transported by the pre-fold accumulator transport. A first diverter is connected to a first material transport and to a second material transport. The diverter is operable to selectively divert materials being transported by the pre-fold accumulator transport to said first or to the second material transport. The first and the second material transport are each connected the insertion subsystem. The second material transport includes a folder subsystem. A second diverter is connected to the first materials transport and to a third material transport. The second diverter is operable to selectively divert materials traveling along the first materials transport to the third material transport which is connected to the insertion subsystem.

In materials handling system of the type having a feeder station having a plurality of material feeders and an insertion subsystem, a method embodying the present invention includes feeding materials from each of the plurality of feeders onto a common material transport path. Materials on the common transport path are selectively transported onto a first material transport path connected to the common material transport path. Materials on the first transport path are transported to the insertion subsystem. Materials on the common transport path are selectively transported onto a second material transport path. The second transport path includes a folder subsystem and is connected to the common material transport path and to the insertion subsystem. Materials on said second transport path are transported to the insertion subsystem. Materials on the first transport path are selectively transported onto a third material transport path connected to the insertion subsystem. Materials on the third transport path are transported the insertion subsystem.

BRIEF DESCRIPTION OF THE DRAWINGS

Reference is now made to the various figures wherein like reference numerals designate similar items in the various views and in which.

DETAILED DESCRIPTION OF THE PREFERRED EMBODIMENT

Figure 1:
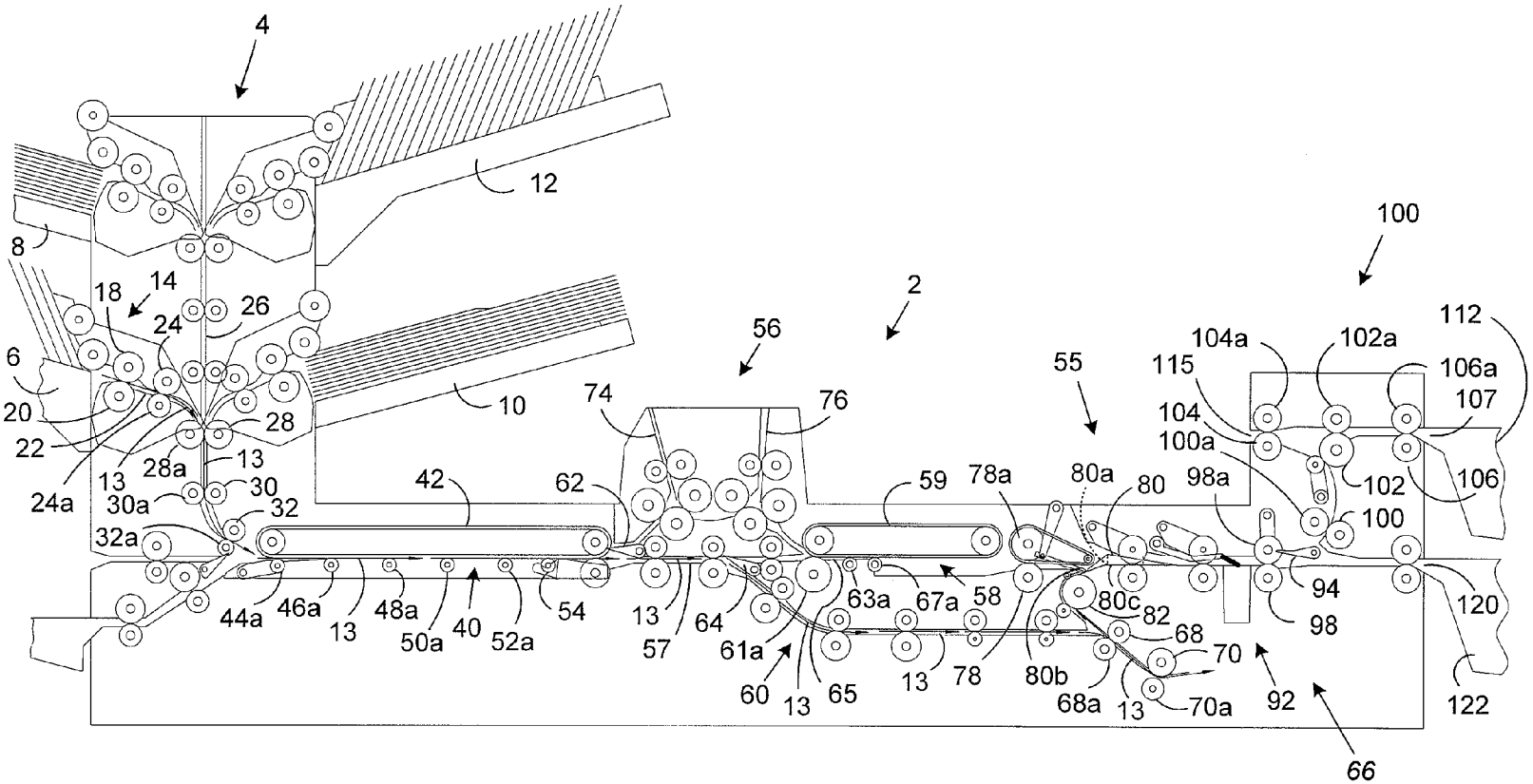
FIG. 1 is a diagrammatic view of a folder inserter system with a common material feed arrangement embodying the present invention and illustrating the envelope transport path from a detachable shingled envelope feed tray to the insertion subsystem.

Reference is now made to the various figures and more particularly to FIG. 1. A folder inserter system 2 includes vertical tower feed station 4 with a common material feed area. The tower feed station 4 provides a common feed area having detachable feed trays and associated feed mechanisms. The feed station 4 includes four separate detachable feed trays 6, 8, 10 and 12 for envelopes, sheets and inserts. Detachable feed tray 6 is a shingle envelope feed tray. Detachable feed tray 8 is a stacks sheet feed tray. Detachable feed tray 10 is a stacks sheet feed tray. Detach able feed tray 12 is a shingle insert feed tray. Various numbers and types of detachable feed trays and associated feeder mechanism can be included in the vertical tower feed station 4. The envelope transport path is depicted by the line 13 with arrowheads from detachable shingle envelope feed tray 4 through various subsystems to the insertion subsystem.

Figure 2:
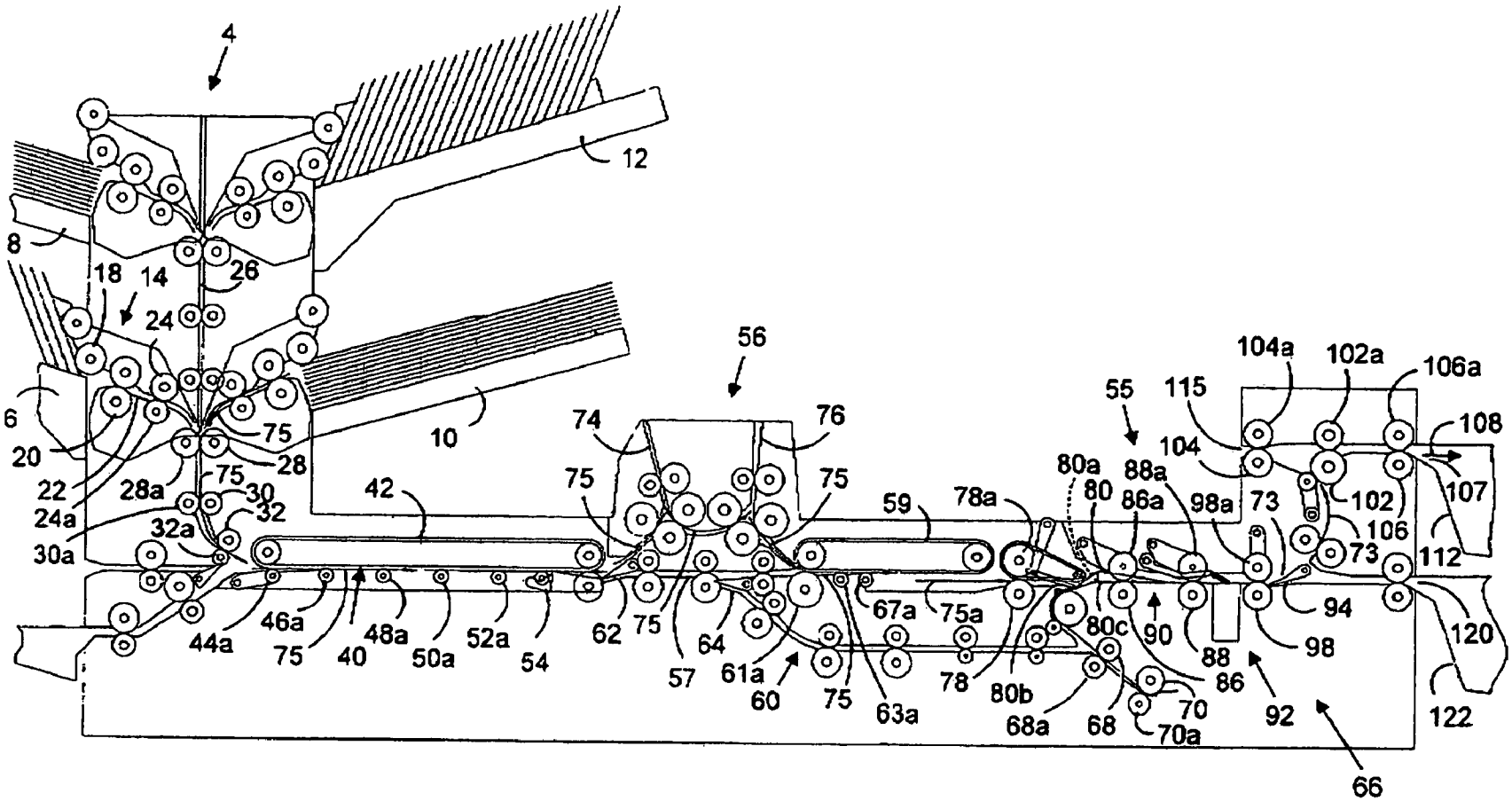
FIG. 2 is a diagrammatic view of the system shown in FIG. 1, illustrating the transport path for material to be folded by folder subsystem from a detachable stack feed tray, through the folder subsystem to the insertion subsystem and the transport path for an envelope from the insertion subsystem through the envelope flap sealer subsystem and through the letter exit to the letter stacker.
Figure 3:
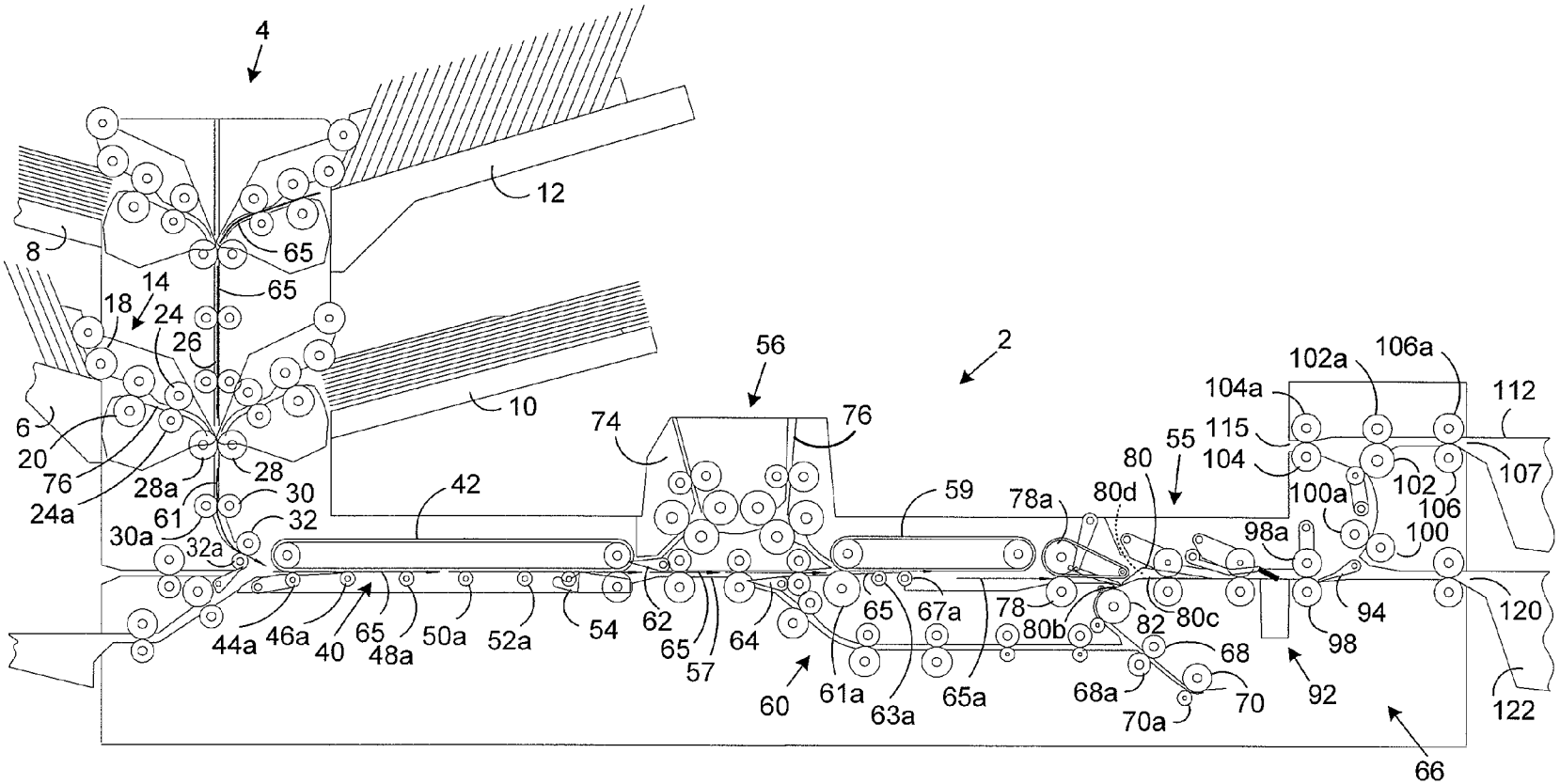
FIG. 3 is a diagrammatic view of the system shown in FIG. 1, illustrating the transport path for material that will not be folded by the folder subsystem from a detachable shingle material feed tray to the insertion subsystem.

Although the detachable feed trays show in FIGS. 1-3 are shown as having envelopes, sheets and inserts, each of these feed trays can feed other types of materials, which can be loaded (depending on the feed tray type) in a stacks or shingle orientation depending on the material involved. Thus, many types of material can be fed by any feed station mechanism. The materials can be, for example, pamphlets, brochures, return envelopes, cards, booklets, slips and checks. Moreover, permanent feed trays or bins of material to be processed can be part of the machine itself rather than detachable feed trays. Also, while identical feed mechanisms are shown for each of the four feeders 6, 8, 10 and 12 specifically designed feeders dedicated to processing particular materials can also be made part of the vertical tower feed station 4 if required for any particular application.

Each of the four feeder mechanisms such as feeder 14, includes a feed head mechanism in the vertical tower and an associated detachable feed tray such as detachable feed tray 6. The mechanisms in the vertical tower for each of the feeders are identical in structure, as previously noted; however, this does not need to be the case. When requirements dictate, the feeder and detachable or fixed materials feed tray or bin can be designed to accommodate specific materials and applications. The material (envelopes) in the detachable feed tray 6 are fed from the tray by the singulator arrangement including a drive roller 18 and retard roller 20. The material is fed from the tray, as depicted by line 13, along the feed head exit guide 22 by take away rollers 24 and associated idler roller 24*a* to a vertical common feed path 26 by the tower drive rollers 28, 30, and 32, with their associated idler rollers respectively 28*a*, 30*a*, and 32*a*.

As the material exits the vertical tower transport path 26, it is moved onto the pre-fold accumulator drive belt arrangement shown generally at 40. The material is driven by the drive belt 42, which operates in conjunction with a series of idler rollers 44*a*, 46*a*, 48*a*, 50*a* and 52*a* to move the material toward the pre-fold accumulator gate 54. The pre-fold accumulator gate 54 is selectively activated to accumulate material when in the blocking position. When in the non-blocking position as shown in FIG. 1, the pre-fold accumulator gate 54 allows accumulated material or non accumulated materials, as the case may be, to pass by the pre-fold accumulator gate 54 to other subsystems in the machine. The material, after passing the pre-fold accumulator gate 54 (when it is in its non-blocking position), will be transported through one of three transport paths to the insertion subsystem 55: the folding subsystem shown generally at 56; the folder bypass path 57 and the post accumulator transport path 58; or the folder bypass path 57 and the envelope transport path 60. The path of travel of the materials depends on the position of the fold/no fold bypass gate 62 and the envelope bypass gate 64.

Fold/no fold bypass gate 62 is selectively activated to divert material from the pre-fold accumulator drive arrangement 40 into the folder subsystem 56 and thereafter to the post accumulator transport path 58 or to bypass the folder subsystem 56. When the fold/no fold bypass gate 62 is positioned to bypass the folder subsystem 56, material from the pre-fold accumulator drive arrangement 40 may be transported onto the post fold accumulator transport path as shown in FIG. 3 or onto the envelope transport path as shown in FIG. 1. The transport path as shown in FIG. 3 from detachable shingle feed tray 12 to the insertion subsystem 55 depicted by the line 65 with arrowheads with the envelope bypass gate 64 is positioned so as not to divert materials being transported into the envelope transport path 60. For the transport path 13 shown in FIG. 1, the envelope bypass gate 64 is positioned so as to divert materials being transported into the envelope transport path 60.

Where the envelope bypass gate 64 is selectively positioned to divert materials (envelopes) to move from the pre-fold accumulator transport arrangement 40 to the envelope transport path 60, the envelope follows the path of travel as depicted by the line 13 through the envelope flap flapper subsystem 66. In the flapper subsystem 66 the envelope flap is opened by the action of controlled drive roller 68 and idler roller 68*a* along with flapper roller 70 and flapper idler roller 70*a*. The drive roller 68 is controlled to stop and reverse direction of rotation so as to transport the envelope with its flap open and trailing the body of the envelope. The envelope is transported toward the insertion subsystem 55 as depicted by line 13.

Figure 4:
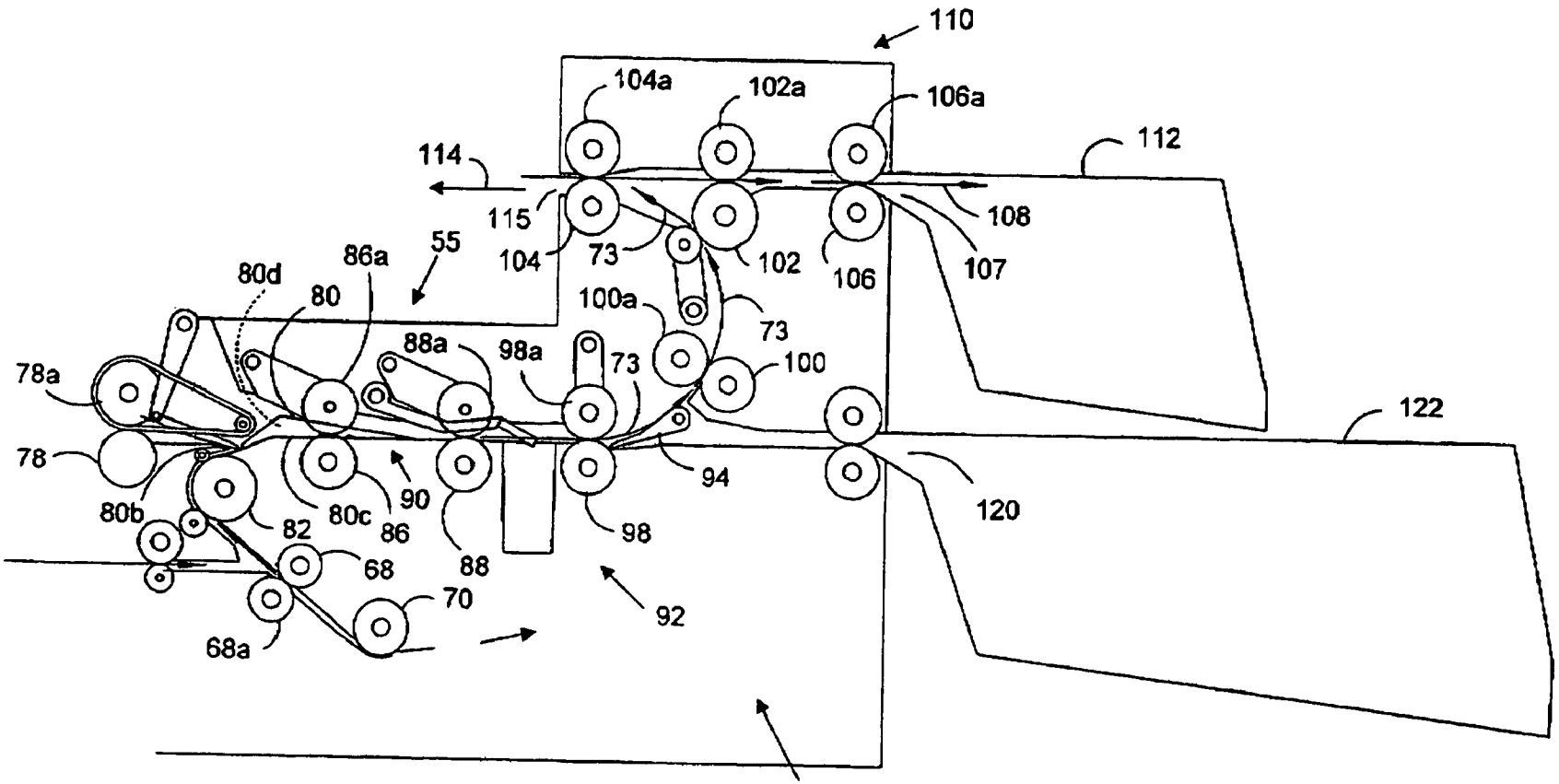
FIG. 4 is an enlarged diagrammatic view of the envelope flapper subsystem, insertion subsystem, moistener subsystem, sealer subsystem and exit portions of the system shown in FIG. 2, illustrating the transport path for letter size envelopes including the path to the letter envelope exit and to the letter stacker; and, FIG. 5 is an enlarged diagrammatic view of the envelope flapper subsystem, insertion subsystem, moistener subsystem, sealer subsystem and exit portions of the system shown in FIG. 1, illustrating the transport path for flats type materials from the insertion subsystem to the flats exit and to the flats stacker.
Figure 5:
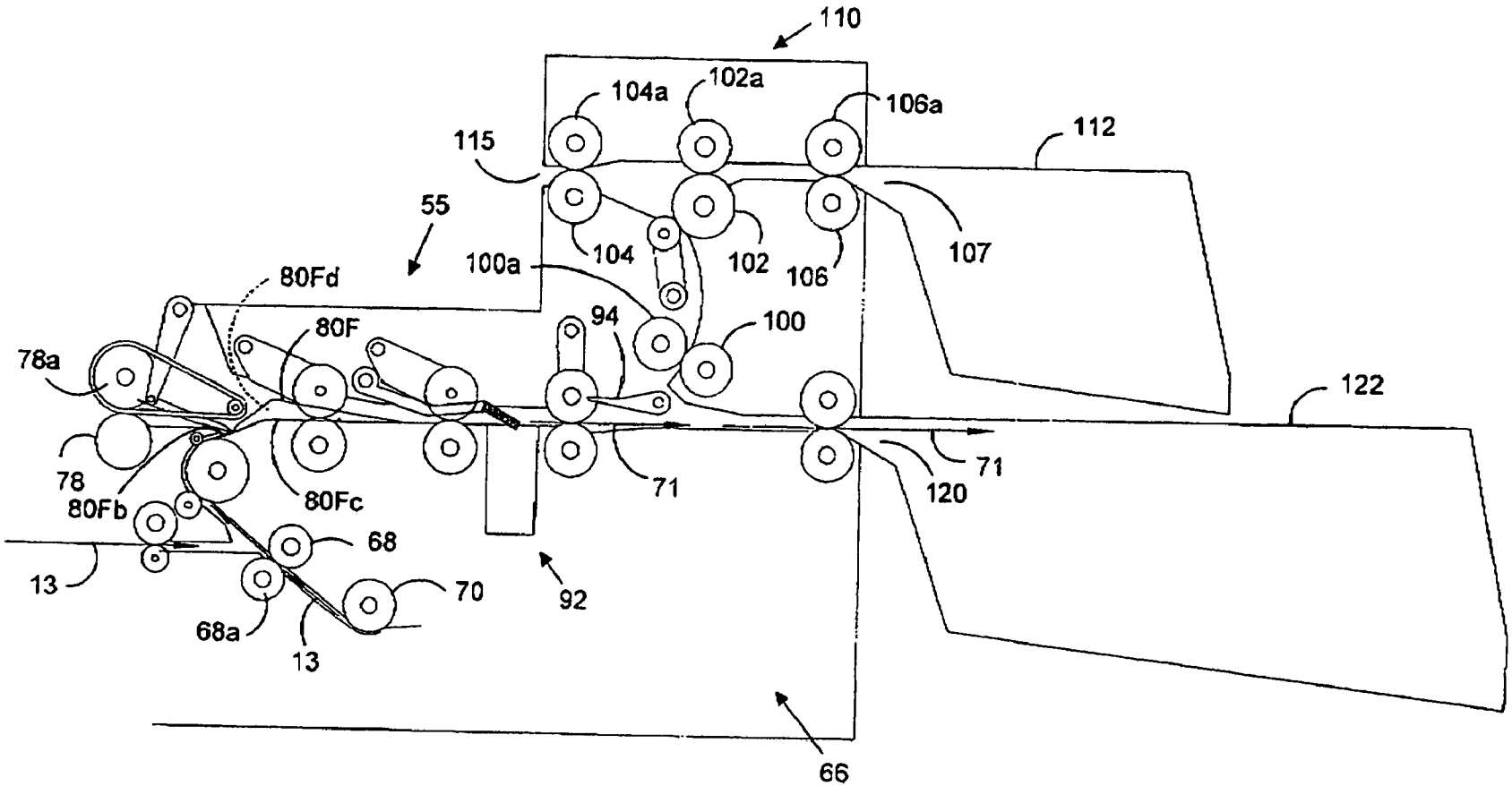

As is more clearly shown in FIG. 5, from the insertion subsystem 55, oversized envelopes with their materials, or stiff letter size envelopes or other materials, depending on the particular application, are moved along the flats envelope transport path depicted by line 71 with arrowheads to exit the machine. Letter-size envelopes, as shown in FIG. 4, are transported along the curved letter size envelope transport path depicted by line 73 with arrowheads to exit the machine. Over size materials are often referred to as flats. In the United States, mail pieces are considered to be flats when the mail piece exceeds at least one of the dimensional regulations of letter-sized mail (e.g. over 11.5 inches long, over 6 inches tall, or over ¼ inch thick) but does not exceed 15 inches by 11.5 by ¾ inch thick. Flats include such mail as pamphlets, annual reports and the like. It should be recognized that what constitutes letter sized mail pieces and oversized mail pieces varies from country to country. Moreover, the dimensions of the folder inserter system 2, such as the dimensions of the various transport paths and machine exits, can be designed to accommodate different sized items. Thus, "letter size" and "flats" terminology are used for convenience are not required sizes for the system to operate properly. The system 2 is capable of processing ranges of materials of differing size in the different transport paths.

Line 75 with arrowheads in FIG. 2 depicts the transport path for material to be folded by the system from the detachable stacks feed tray 10 to the insertion subsystem 55. Material to be folded are shown as being moved from the detachable stack feed tray 10 in the direction of line 75 transported along the vertical tower common feed path 26, the pre-fold accumulator transport arrangement 40 and, whether or not accumulated into multiple materials such as sheets, past the fold/no fold bypass gate 62 into the folder subsystem 56. In folder subsystem 56 the material is folded in folders 74 and 76 by controlled rollers or by other conventional means such as buckle chutes. It should be recognized that other materials processing subsystems can be employed with or replace the folder subsystem 56. Examples of such other subsystems are printing subsystems, paper perforation subsystems, stapling subsystems, hole punch subsystems and the like.

Materials are selectively moved from the various feeders onto the common transport path 26 and onto the pre-fold accumulator drive belt transport 42. Depending on the particular materials and process to be implemented, three separate transport paths are provided to the insertion subsystem 55. The materials may be selectively transported into the folder subsystem 56 or directed for ongoing transport depending on the position of the fold/no fold bypass gate 62. Materials directed for ongoing transport will either: travel along the folder bypass path 57 and the post accumulator transport as shown in FIG. 3 (portion of line 65 to the right of envelope bypass gate 64); or, as shown in FIG. 1 along the folder bypass path 57 and the envelope transport path 60 (portion of line 13 to the right of envelope bypass gate 64). The path of travel for this material directed for ongoing transport depends on the position of the envelope bypass gate 64. Thus all materials are transported along a common transport path and then selectively directed onto one of three different transport paths as they are moved to the insertion subsystem 55. This transport arrangement from a common feed area to the insertion subsystem provides enhanced flexibility of operation of the system and facilitates the utilization of a common feed area.

The material exits the folder subsystem 56 and is transported along the post-fold accumulator transport 58 by the post fold accumulator transport belt 59 and its associated rollers idler 61*a*, 63*a* and 67*a* to the insertion subsystem 55. The material traveling along the transport path depicted by line 75 (FIG. 2), or as the case may be, line 65 (FIG. 3), is controlled to accumulate as illustrated by the portion 75*a* of line 75 and 65*a* of line 65, as the case may be. This is achieved by stopping the rotation of controllable drive rollers 78 and thus stopping the movement of the materials through the nip of controllable drive rollers 78 and idler roller 78*a* when desired to accumulate material. The material or accumulated material is driven into the envelope 80, shown at the insertion subsystem 55 with the envelope flap 80*b* positioned around the envelope positioning roller 82 and the body of the envelope 80*c* having the address or window side of the envelope facing downward. The throat of the envelope 80*d* is extended by mechanical fingers, not shown, to enable insertion of the material into the envelope 80.

After the material is inserted into the envelope 80 as shown in FIGS. 2 and 4, the envelope exit drive rollers 86 and 88, in conjunction with idler rollers 86*a* and 88*a*, drive the envelope along the insertion deck 90 past an envelope flap glue line moistener subsystem shown generally at 92. A flats bypass gate 94 is shown positioned to cause an envelope, when driven along the insertion deck 90, to move along the curved envelope letter size transport path as depicted by line 73. The moistener subsystem 92 can be any of a variety of standard moistening arrangements to moisten the envelope flap glue line for sealing to the body of the envelope. As an envelope is driven into and along the curved letter transport path, the envelope is driven by a series of drive rollers 98, 100, 102, 104 and 106 and associated idler rollers 98*a*, 100*a*, 102*a*, 104*a* and 106*a*.

When an envelope body 80*c* is captured between drive roller 104 and its corresponding idler roller 104*a*, at a particular point, depending upon the size of the envelope, driver roller 104 will stop and reverse direction of rotation. The direction of rotation is reversed to drive the envelope to exit the machine along the letter size exit transport path as depicted by line 108 with arrowheads. The envelope flap 80*b* is caused to move against the body of the envelope 80*c* and is sealed in the sealer subsystem 110 by the force of drive roller 106 and sealer idler roller 106*a*. In this manner, a letter size envelope is transported from the insertion subsystem 55 along the curved letter size transport path into the sealer subsystem 110 and then along the letter size envelope exit transport path 108. The envelope body 80*c* exits the machine exit 107 into the letter stacker 112 the along the exit transport path 108. The envelope exits the machine with the address or window side of the envelope facing upward. This is a reversal of the orientation of the body of the envelope 80*c* from the envelope body orientation at the insertion subsystem 55. This change in orientation to exit the machine with the address or window side of the envelope body facing upward, facilitates further processing of the envelope, such as by a mailing machine or other device, stacker, printer, scanner and the like. If the envelope or other material is to be rejected for some reason, the envelope drive roller 104 would not change direction and the material would be caused to exit the machine along reject transport path 114, through the reject exit 115 to a reject bin, not shown.

Line 71 with arrowheads depicts an envelope path of travel for a flats type envelope 80F from the insertion subsystem 55 being transported along insertion deck 90 past the moistener subsystem 92 and being directed by the flats bypass gate 94 through the flats exit 120 and into the flats stacker 122. The flats envelope 80F is transported from a suitable detachable feed tray to the insertion subsystem 55 along the transport path depicted by line 13. The designations 80Fb, 80Fc and 80Fd correspond to letter size envelope 80 part designations Without inserts, the flats envelope 80F is sufficiently flexible to accommodate the curved portions of the transport path 13. The exit transport path depicted by line 71 may be employed for various materials depending on the application. For example, a stiff letter size envelope that is not sufficiently flexible with the inserts to be transported along the curved letter size transport may be directed along exit transport path 71. As can be seen, the flats bypass gate 94 is positioned in FIG. 5 to cause the flats material to be driven along the flats exit transport path 71 to exit the flats exit 120 into the flats stacker 122. It should be noted that in this embodiment, the flats envelope flap is not sealed. A sealer can be added at the flats path exit 120 or at another suitable point in the machine to operate independently or in conjunction with moistener subsystem 92, depending upon the particular design of the system.

From the insertion subsystem 55, three transport paths and three separate exit paths are provided and utilized depending on the nature of the material and the process to be achieved. The material can, as is shown in FIG. 5, move along the insertion deck 90, the flats transport path 71 and through flats exit 120 into stacker 122. This is a straight transport path. The material can as is shown in FIG. 4, pass along the insertion deck 90, along curved letter size transport path 73, exit transport path 108 and through letter exit 107 into stacker 112. The material can, as is shown in FIG. 4, pass along the insertion deck 90, along curved letter size transport path 73, reject transport path 114 and through reject exit 115 into a reject bin not shown. This combination of transport exit paths provides enhanced flexibility of the operation of the system.

It should be recognized while specific belt and drive roller transport arrangements are shown in FIGS. 1-5, other suitable transport arrangements can be employed. Moreover, the orientation, shape and arrangement of the various transport paths can be modified to accommodate different types of materials and applications. Also, the various subsystems can be replaced by different conventional subsystems or by other materials processing subsystems. Thus, while the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. A materials handling system, comprising:

a common transport path;

a feeder station having a first feed mechanism for feeding an enclosure envelope to the common transport path and at least one second feed mechanism for feeding material to common transport path, the material for insertion into the enclosure envelope;

an insertion subsystem for inserting said material from said at least one second feed mechanism into said enclosure envelope;

a folder subsystem for folding said material from said at least one second feed mechanism;

a first transport path connected to said common transport path and to said insertion subsystem for transporting said material from said common transport path to said insertion subsystem for insertion into said the enclosure envelope;

a second transport path connected to said common transport path, said folder subsystem and said insertion subsystem, said second transport path for transporting said material from said common transport path to said folding subsystem for folding and transporting folded material to said insertion subsystem for insertion into said the enclosure envelope; and a third transport connected to said common transport path and to said insertion subsystem, said third transport path for transporting said envelope from said common transport path to said insertion subsystem.

2. A material handing system as defined in claim 1 wherein said common transport path is in a substantially vertical direction for at least a portion of its path of travel and each of said first, said second and said third transport paths is in a substantially horizontal direction for at least a portion of its path of travel.

3. In a materials handling system having a feeder station including a common transport path, a first feed mechanism for feeding an enclosure envelope to said common transport path and at least one second feed mechanism for feeding material to be inserted into said enclosure envelope to said common transport path, a method comprising the steps of:

feeding said enclosure envelope from said first feed mechanism to said common transport path;

passing said enclosure envelope from said common transport to a first transport path to transport said enclosure envelope from said common transport path to an insertion subsystem;

opening said enclosure envelope in said insertion subsystem to provide an opened enclosure envelope;

feeding material from said at least one second feed mechanism to said common transport path;

selectively passing said material from said common transport path to a second transport path or a third transport path, said second transport path transporting said material to said insertion subsystem, said third transport path transporting said material to a folder subsystem;

for said material passed to said second transport path, inserting said material into said opened enclosure envelope with said insertion subsystem;

for said material passed to said third transport path, folding said material with said folder subsystem and to provide folded material and then transporting said folded material to said insertion subsystem; and inserting said folded material into said opened enclosure envelope with said insertion subsystem.

* * * * *